US006411791B2

(12) United States Patent
Nittani et al.

(10) Patent No.: US 6,411,791 B2
(45) Date of Patent: Jun. 25, 2002

(54) DEVELOPING APPARATUS INCLUDING A DEVELOPER CHARGING MEMBER SHAFT AND A HOLDING MEMBER INCLUDING A SHAFT GUIDE GROOVE

(75) Inventors: Susumu Nittani, Shizuoka-ken; Jun Miyamoto, Mishima; Tatsuya Suzuki, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/758,117

(22) Filed: Jan. 12, 2001

(30) Foreign Application Priority Data

Jan. 12, 2000 (JP) ..... 2000-003921
Jan. 14, 2000 (JP) ..... 2000-010203

(51) Int. Cl.[7] ..... G03G 15/08
(52) U.S. Cl. ..... 399/281; 399/119
(58) Field of Search ..... 399/119, 270, 399/271, 272, 274, 281, 282, 284, 285

(56) References Cited

U.S. PATENT DOCUMENTS 4,835,565 A * 5/1989 Nagatsuna et al. ..... 399/281
4,937,624 A 6/1990 Kohtani et al.
4,937,626 A 6/1990 Kohtani et al.
5,600,423 A 2/1997 Miyashiro et al. ..... 399/313
5,887,227 A 3/1999 Kawai et al. ..... 399/98
6,047,150 A 4/2000 Kanno et al. ..... 399/119
6,070,027 A 5/2000 Kawai et al. ..... 399/103
6,091,913 A 7/2000 Suzuki et al. ..... 399/49
6,104,895 A 8/2000 Yokomori et al. ..... 399/113
6,229,979 B1 * 5/2001 Ishii et al. ..... 399/281

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A developing apparatus includes a developing frame having an opening portion a developer carrying member provided in the opening portion and is adapted to carry developer a developer charging member contacted with the developer carrying member and is adapted to charge the developer carried by the developer carrying member. A voltage is applied to the developer charging member. A holding member, provided at a longitudinal end portion of the developing frame, is adapted to hold the developer carrying member and the developer charging member.

7 Claims, 10 Drawing Sheets

DEVELOPING APPARATUS INCLUDING A DEVELOPER CHARGING MEMBER SHAFT AND A HOLDING MEMBER INCLUDING A SHAFT GUIDE GROOVE

BACKGROUND OF THE INVENTION

1. Field of the Invention

The present invention relates to a developing apparatus preferably used in an image forming apparatus for forming an image on a recording material, such as a copying machine, a printer, a facsimile apparatus and a word processor.

2. Related Background Art

Conventionally, as an arrangement for forming an image through an electrophotographic system, there has been proposed a technique in which a latent image is formed by selectively exposing a drum-shaped electrophotographic photosensitive member (referred to as "photosensitive drum" hereinafter) as an image bearing member uniformly charged by a charging apparatus, and the latent image is developed by a developing apparatus with developer (referred to as "toner" hereinafter) to visualize the latent image as a toner image, and the toner image is transferred onto a recording material, thereby effecting the image recording.

As an example of such a developing apparatus, a developing apparatus as shown in FIG. 10 has been proposed and put to practical use.

In this conventional developing apparatus, a developing container 120 containing nonmagnetic one-component toner is provided with a developing roller 112 as a developer carrying member, a developing blade 116 as a developer regulating member, and a coating roller 119 as a developer coating member.

The coating roller 119 is disposed to be abutted against the developing roller 112 at a position upstream of an abutment position between the developing blade 116 and the developing roller 112 in a rotational direction of the developing roller 112, so that the toner is supplied onto the developing roller 112 by rotating the coating roller in a direction shown by the arrow R2 in FIG. 10.

The toner supplied to the developing roller 112 is sent to the abutment position constituted with the developing blade 116 as the developing roller 112 is rotated.

The toner on the developing roller 112 is brought to a uniform thin layer (toner coat) by the developing blade 116, and, at the same time, charges are applied to the toner layer by friction with the developing blade 116.

Developing bias is applied to the developing roller 112, so that the toner on the developing roller is transferred onto the electrostatic latent image formed on a photosensitive drum 101, thereby visualizing the latent image as a toner image on the photosensitive drum 101.

However, in case of the above-mentioned conventional technique, the following problem arose.

Depending upon environment (temperature, humidity and the like) within which the developing apparatus is installed, a charging amount of charges on the developing roller may become unstable, thereby affecting an influence upon image quality.

In the past, in order to reduce the influence of such environment, a value of the developing bias has been adjusted in accordance with the environment to maintain the image quality constant.

SUMMARY OF THE INVENTION

An object of the present invention is to provide a developing apparatus in which a charging amount of charges of developer on a developer carrying member can stably be obtained under various environments.

Another object of the present invention is to provide a developing apparatus having an excellent assembling ability.

The other object of the present invention is to provide a developing apparatus in which position setting of a developer charging member for charging developer on a developer carrying member and that of the developer carrying member can easily be done.

DETAILED DESCRIPTION OF THE PREFERRED EMBODIMENTS

Now, preferred embodiments of the present invention will be fully explained exemplarily with reference to the accompanying drawings. However, it should be noted that dimensions, materials, configurations and relative positions of constructural parts described in the embodiments can be appropriately changed in accordance with an arrangement of an apparatus to which the present invention is applied and various conditions, and the present invention is not limited to embodiments described hereinbelow.

First of all, a developing apparatus according to an embodiment of the present invention, a process cartridge having such a developing apparatus, and an image forming apparatus using such a developing apparatus will be described.

In the follwing explanation, a term "longitudinal direction" means a direction substantially perpendicular to a recording material conveying direction and substantially parallel with a surface of a recording material.

Figure 1:
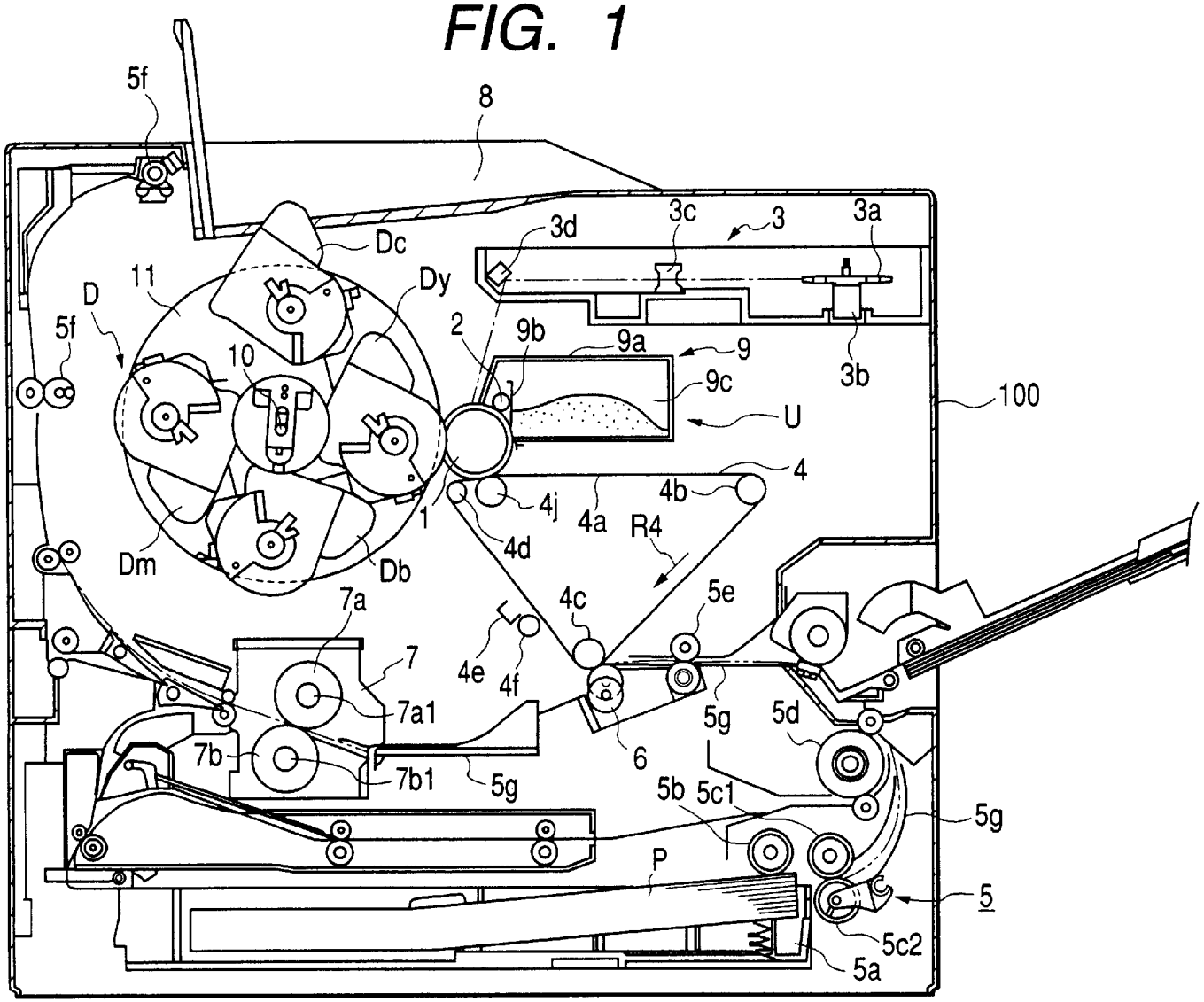
FIG. 1 is a sectional view showing an entire image forming apparatus according to an embodiment of the present invention.

First of all, a schematic construction of an image forming apparatus 100 according to the embodiment will be explained. FIG. 1 is a side sectional view of a color laser beam printer as one form of the image forming apparatus for forming a color image through an electrophotographic system.

A surface of a drum-shaped electrophotographic photosensitive member (referred to as "photosensitive drum" hereinafter) 1 as an image bearing member rotated at a constant speed is uniformly charged by charging means 2. An electrostatic latent image is formed by illuminating a laser beam corresponding to image information from exposing means 3 onto the photosensitive drum 1, and the latent image is developed by four developing cartridges Dm, Dc, Dy, Db (generically designated by "D") (developing apparatus).

Developed images formed on the photosensitive drum 1 are successively transferred onto a belt-shaped intermediate transfer unit 4 in a superimposed fashion, thereby forming a color image.

The color image is transferred, by transfer means 6, onto a recording material P (for example, a recording paper, an OHP sheet and the like) conveyed from a sheet supplying portion by conveying means 5. The recording material P is conveyed to fixing means 7, where the color image is fixed to the recording material. Thereafter, the recording material P is discharged onto a discharge portion 8 formed on an upper surface of the apparatus.

Next, various parts will be concretely described.

In order to form a process cartridge U, the photosensitive drum 1 is integrally formed with a container-like frame 9*a* of cleaning means 9 for removing developer (referred to as "toner" hereinafter) remaining on the photosensitive drum 1 after the toner image was transferred to the intermediate transfer unit 4.

The process cartridge U is detachably mounted on a main body 100 of the image forming apparatus so that the user can exchange it for a new one when the service life of the process cartridge is expired.

The photosensitive drum 1 is constituted by coating an organic photoconductive layer on an outer surface of an aluminium cylinder having a diameter of about 50 mm and is rotatably supported within the container-like frame 9*a* of the cleaning means 9 also acting as a holder of the photosensitive drum 1.

On the periphery of the photosensitive drum 1, there are provided a cleaning blade 9*b* for scraping and removing the toner remaining on the photosensitive drum 1, and the charging means 2.

Accordingly, in the illustrated embodiment, the photosensitive drum 1, the cleaning means 9 and the charging means 2 constitute the process cartridge U detachably mountable integrally to the main body 100 of the image forming apparatus.

Further, the photosensitive drum 1 is rotated in a counterclockwise direction in FIG. 1, in accordance with image formation, by transmitting a driving force of a driving motor (not shown).

The charging means 2 according to the illustrated embodiment uses a so-called contacting charging method and serves to uniformly charge the surface of the photosensitive drum 1 by applying voltage to a conductive roller as charging member rotated and contacted with the surface of the photosensitive drum The exposing means 3 for exposing the charged photosensitive drum 1 serves to illuminate image light corresponding to image information onto a polygon mirror 3*a* when an image signal is applied to a laser diode (not shown).

The polygon mirror 3*a* is rotated at a high speed by a scanner motor 3*b*, and the image light reflected by the mirror 3*a* selectively expose the surface of the photosensitive drum 1 rotated at a constant speed through a focusing lens 3*c* and a reflection mirror 3*d*, thereby forming the electrostatic latent image.

The latent image is developed by the developing cartridges (developing apparatus) D for respective colors. The developing cartridges will be described later.

The toner images developed by the developing cartridges D are successively transferred onto the intermediate transfer unit 4. The intermediate transfer unit 4 as a second image bearing member effects secondary transfer collectively the plural toner images effected primary transfer successively from the photosensitive drum 1 in the superimposed fashion onto the recording material P.

The intermediate transfer unit 4 has an intermediate transfer belt 4*a* running in a direction shown by the arrow R4. The intermediate transfer belt 4*a* according to the illustrated embodiment is a belt having a peripheral length of about 440 mm and is wound around a driving roller 4*b*, a secondary-transfer counter roller 4*c* and a driven roller 4*d*.

Further, there is provided a pressing roller 4*j* shifted between a position where this roller comes close to urge the intermediate transfer belt 4*a* against the photosensitive drum 1 and a position where this roller is retarded to separate the intermediate transfer belt 4*a* from the photosensitive drum 1.

The intermediate transfer belt 4*a* is rotated in the direction R4 by rotation of the driving roller 4*b*. Further, at a predetermined position on an outer side of the intermediate transfer belt 4*a*, there is provided a cleaning unit 4*e* capable of engaging and disengaging the surface of the intermediate transfer belt 4*a* and serving to remove the residual toner remaining on the belt after the toner images were collectively transferred to the recording material P.

In the cleaning unit 4*e*, a charging roller 4*f* is contacted with the intermediate transfer belt 4*a* and charge having polarity opposite to that in the toner transferring is applied to the charging roller. The toner subjected to the opposite charge is electrostatically adhered to the photosensitive drum 1 at a primary transfer position and thereafter is removed and collected by the cleaning device 9 (described later) for the photosensitive drum 1.

Incidentally, as a cleaning method for the intermediate transfer belt 4*a*, mechanical means such as a blade or a fur brush or combination thereof may be used, as well as the above-mentioned electrostatic cleaning.

Incidentally, the toner remaining on the surface of the photosensitive drum 1 after the toner images were transferred to the intermediate transfer unit 4 is removed by the cleaning means 9. That is to say, the toner is scraped from the cleaning blade 9*b* as a cleaning member abutted against the surface of the photosensitive drum 1 and is collected into a removed toner container 9*c*. The removed toner container 9*c* is constituted by a cleaning frame 9*a*.

A volume of the removed toner container 9*c* is selected so that the container is not filled with the removed toner collected in the waste toner container 9*c* before the service life of the photosensitive drum 1 is expired, and the toner in the removed toner container 9*c* is exchanged simultaneously with exchange of the cleaning unit U when the service life of the photosensitive drum 1 is expired.

In the illustrated embodiment, the transfer means 6 for transferring the toner images transferred to the intermediate transfer unit 4 in the superimposed fashion to the recording material P has a transfer roller as a transfer member, and the transfer roller 6 is constituted by coating a middle resistance foam elastic body on a metal shaft and can be shifted in an up-and-down direction in FIG. 1.

The transfer roller 6 is positioned at a lower position (shown by the solid line in FIG. 1) where the roller is separated from the intermediate transfer unit 4 so as not to distort the toner images during the formation of four color toner images on the intermediate transfer unit 4, i.e., during plural rotations of the intermediate transfer unit 4.

After the color toner image was formed by transferring the toner images to the intermediate transfer unit 4 in the superimposed fashion, at a timing when the color toner image is transferred to the recording material P, the transfer roller 6 is shifted upwardly as shown by the chain line in FIG. 1 by a cam (not shown).

As a result, the transfer roller 6 is urged against the intermediate transfer unit 4 via the recording material P with predetermined pressure. At the same time, bias voltage is applied to the transfer roller 6, thereby transferring the toner images on the intermediate transfer unit 4 onto the recording material P.

For example, as shown in FIG. 1, the conveying means 5 for conveying the recording material P is provided with a sheet feeding cassette 5*a* containing a plurality of recording materials P, a pick-up roller 5*b*, a sheet feeding roller 5*c*, a retard roller 5*c*2 for preventing double-feed of recording materials, a pair of conveying rollers 5*d*, a pair of registration rollers 5*e*, a pair of discharge rollers 5*f* and a conveying guide 5*g*.

During the image formation, the pick-up roller 5*b* is rotated in synchronous with the image formation so that the recording materials P in the sheet feeding cassette 5*a* are separated and fed one by one. The recording material P fed from the sheet feeding cassette 5*a* is guided by the conveying guide 5*g* and is sent to the pair of registration rollers 5*e* through the pair of conveying rollers 5*d*.

During the image formation, the pair of registration rollers 5*e* effect nonrotation action for stopping and holding the recording material P and rotation action for conveying the recording material P toward the intermediate transfer unit 4, at a predetermined sequence, to align the image with the recording material P in the transferring process as the next process, and the color toner image is transferred by the above-mentioned transfer means.

The recording material P to which the color toner image was transferred is conveyed to the fixing means 7, where the toner image is fixed to the recording material. The fixing means 7 comprise a fixing roller 7*a* for applying heat to the recording material P, and a pressure roller 7*b* for urging the recording material P against the fixing roller 7*a*, and the rollers 7*a*, 7*b* are hollow rollers each including a heater therein and are rotatingly driven. The toner image is fixed to the recording material P by applying heat and pressure to the recording material while conveying the recording material P.

The recording material to which the toner was fixed is discharged onto a discharge portion 8 by the pair of discharge rollers 5*f* of the conveying means.

Next, the developing cartridges for developing the latent image formed on the photosensitive drum 1 will be explained.

The image forming apparatus has four developing cartridges D (Dm, Dc, Dy, Db) capable of developing magenta, cyan, yellow and black colors to form a full-color image. As shown in FIG. 1, the developing cartridges D are detachably mounted on a rotary unit 11 rotated around a shaft 10.

During the image formation, the developing cartridges D are rotated around the shaft 10 while being held on the rotary unit 11. Each developing cartridge D containing the respective color toner is stopped at a position opposed to the photosensitive drum 1. Further, after a developing roller (described later) is positioned with respect to the photosensitive drum 1, the toner is supplied in accordance with the electrostatic latent image on the photosensitive drum 1, thereby developing the latent image. The developer contained in each developing cartridge is non-magnetic one-component toner, and the developing roller is urged against and in contact with the photosensitive member to effect the contact development.

During the color image formation, whenever the intermediate transfer unit 4 is rotated, the rotary unit 11 is rotated so that the development is effected by using the magenta developing cartridge Dm containing magenta color toner, cyan developing cartridge Dc containing cyan color toner, yellow developing cartridge Dy containing yellow color toner, and black developing cartridge Db containing black color toner successively.

Figure 2:
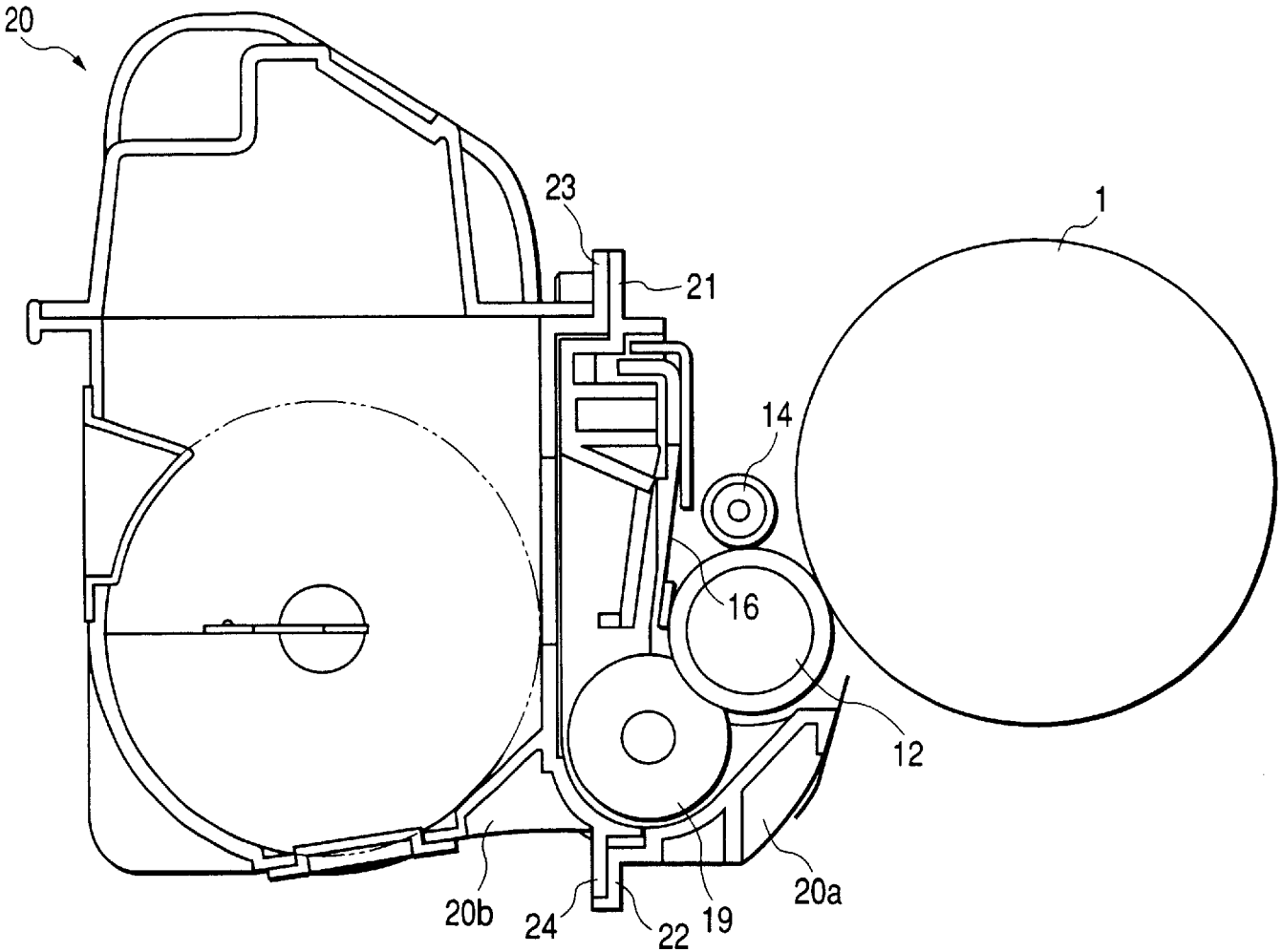
FIG. 2 is a sectional view showing a frame arrangement of a developing cartridge according to an embodiment of the present invention.
Figure 3:
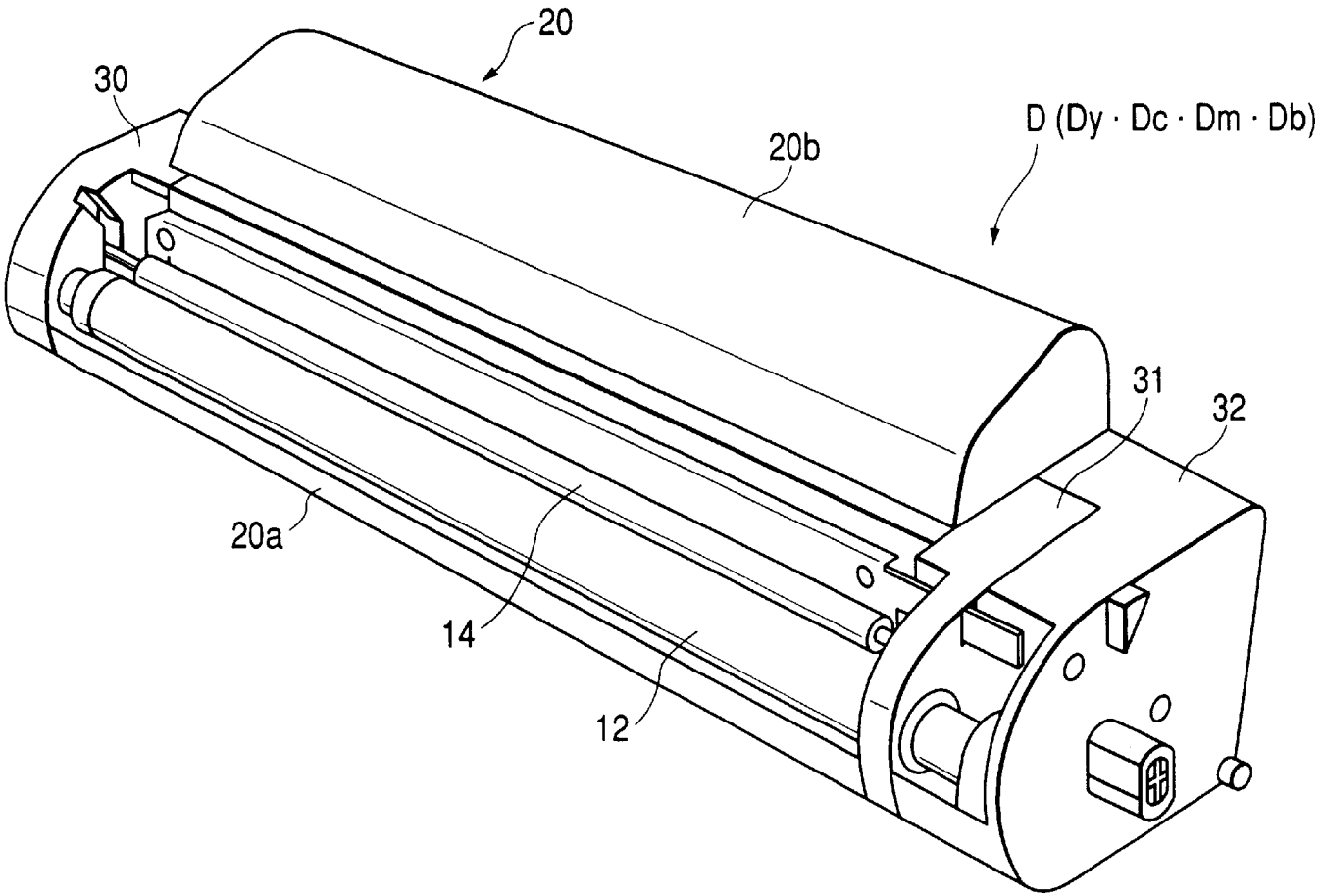
FIG. 3 is a perspective view showing the frame arrangement of the developing cartridge according to the embodiment of the present invention.

As shown in FIGS. 2 and 3, a cartridge frame 20 is constituted by a developing frame 20*a*, a toner container 20*b*, developing bearings 30, 31, as holding members, and a side cover 32.

As shown in FIG. 2, regarding the developing frame 20*a* and the toner container 20*b*, flanges 21, 22 provided on both ends (in a direction crossing a longitudinal direction of the developing frame 20*a*) along the longitudinal direction of the developing frame and connection faces 23, 24 provided on the toner frame 20*b* are interconnected by ultrasonic welding and the like.

Further, as shown in FIG. 3, on both ends in the longitudinal direction of the developing frame 20*a* and toner container 20*b* connected as described above, the developing bearings 30, 31 as holding members are fixed by screws, and the side cover 32 is secured to the developing bearing 31 by a screw. In this way, all of the frames constitute the integral cartridge frame 20.

The developing frame 20*a* includes a developing roller 12 as a developer carrying member for developing the latent image formed on the photosensitive drum 1, a toner supplying roller 19 for supplying the toner to the peripheral portion of the developing roller, a developing blade 16 as a developer regulating member for forming a thin toner layer on the developing roller 12, and a charging roller 14 which is a rotary member as a developer charging member.

Next, attachment of the toner supplying roller 19 and the developing blade 16 to the developing frame 20*a* will be explained.

Figure 4:
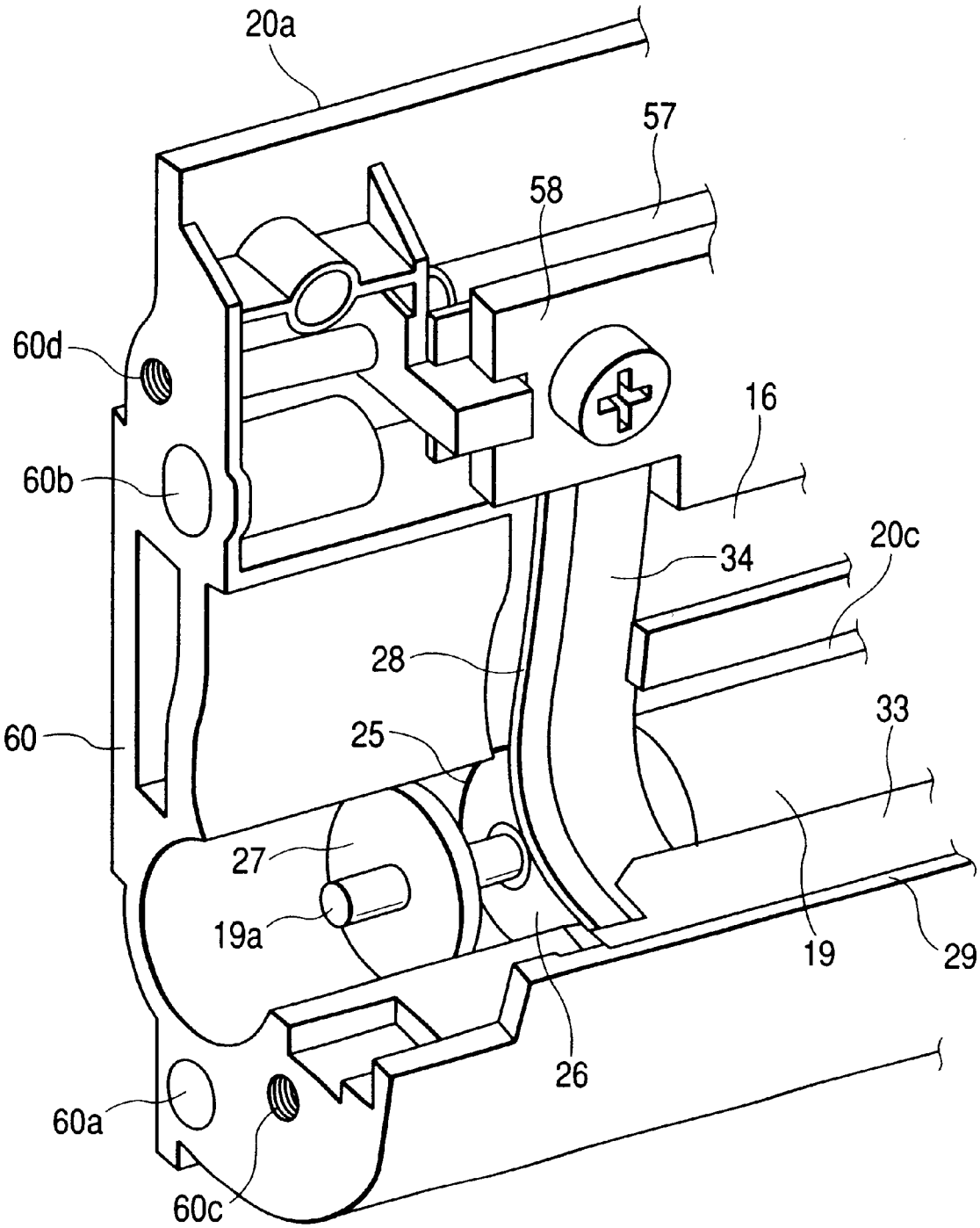
FIG. 4 is an exploded perspective view of a developing device according to an embodiment of the present invention.

FIG. 4 shows an end (non-drive side end) of the developing frame 20*a* opposite to an end in which the developing cartridge D is subjected to a driving force from the main body of the image forming apparatus. The developing frame 20*a* is provided with a notch 25 for receiving the toner supplying roller 10.

The toner supplying roller 19 is incorporated into the developing frame 20*a* by inserting a shaft 19*b* (FIG. 7) on an end (driving side end) in which the developing cartridge D of the developing frame 20*a* is subjected to the driving force from the main body of the image forming apparatus into a through-hole (FIG. 7) provided in the drive side end of the developing frame 20*a* and then by entering a shaft 19*a* (FIG. 4) on the other end into the notch 25 of the developing frame 20*a*.

Thereafter, in order to seal the notch 25 of the developing frame 20*a*, a bush 26 having a shape fitted into the notch is attached. Further, packings 27 for sealing the shafts in the rotational direction are attached to the shafts 19*a*, 19*b* of the toner supplying roller 19.

Figure 5:
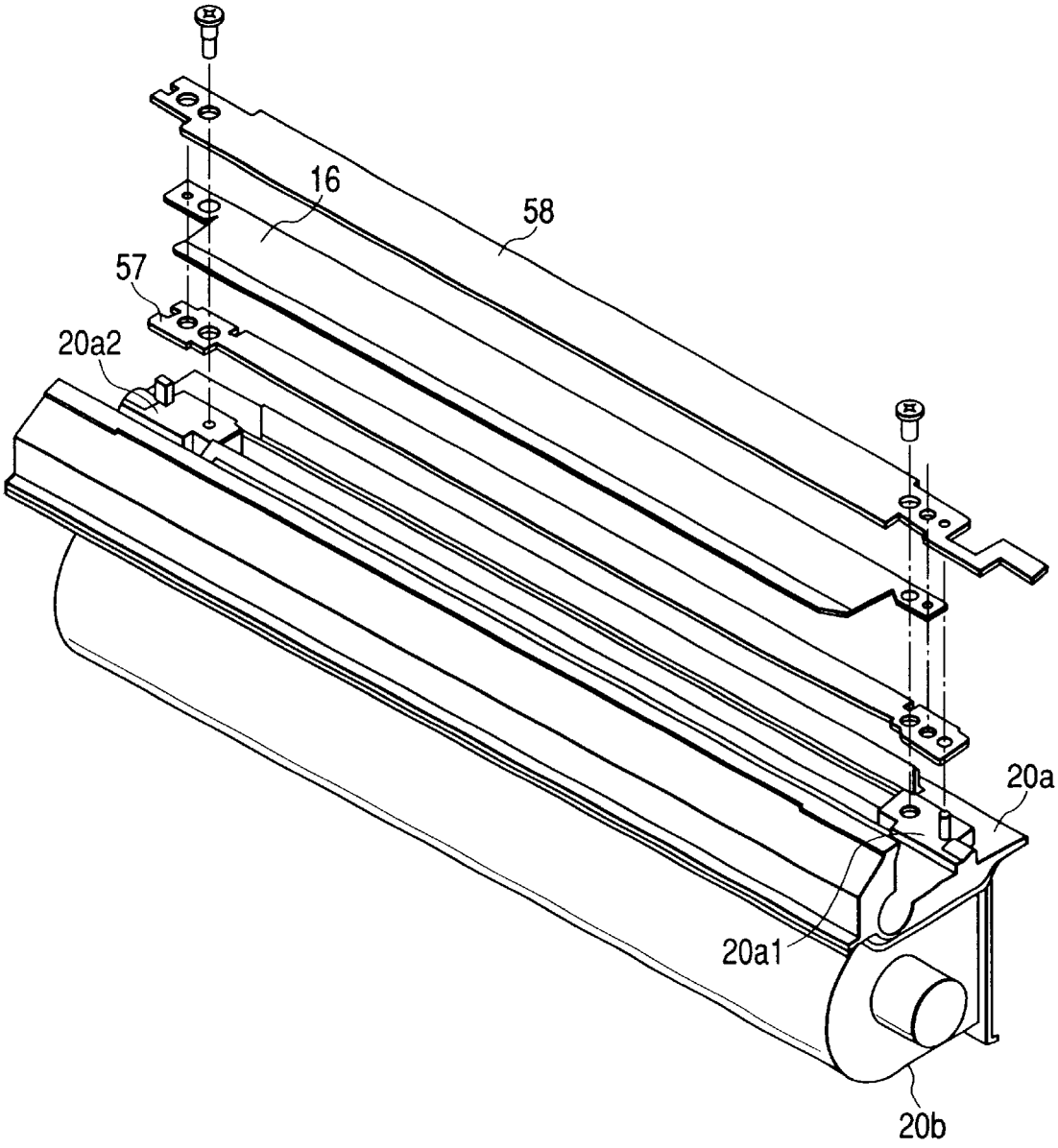
FIG. 5 is an exploded perspective view of a developing device according to an embodiment of the present invention.

Seal seat faces 28, 29 are provided on both ends and longitudinal direction of an opening portion 20*c* of the developing frame 20*a*. After the toner supplying roller 19 is incorporated, seal members 33, 34 are adhered to the seat faces, thereby preventing the toner from leaking from the opening portion 20*c* of the developing frame. After the seals are adhered, as shown in FIGS. 4 and 5, a base plate 57, developing blade 16 and pressing plate 58 are attached to blade seat faces 20*a*1, 20*a*2.

Figure 6:
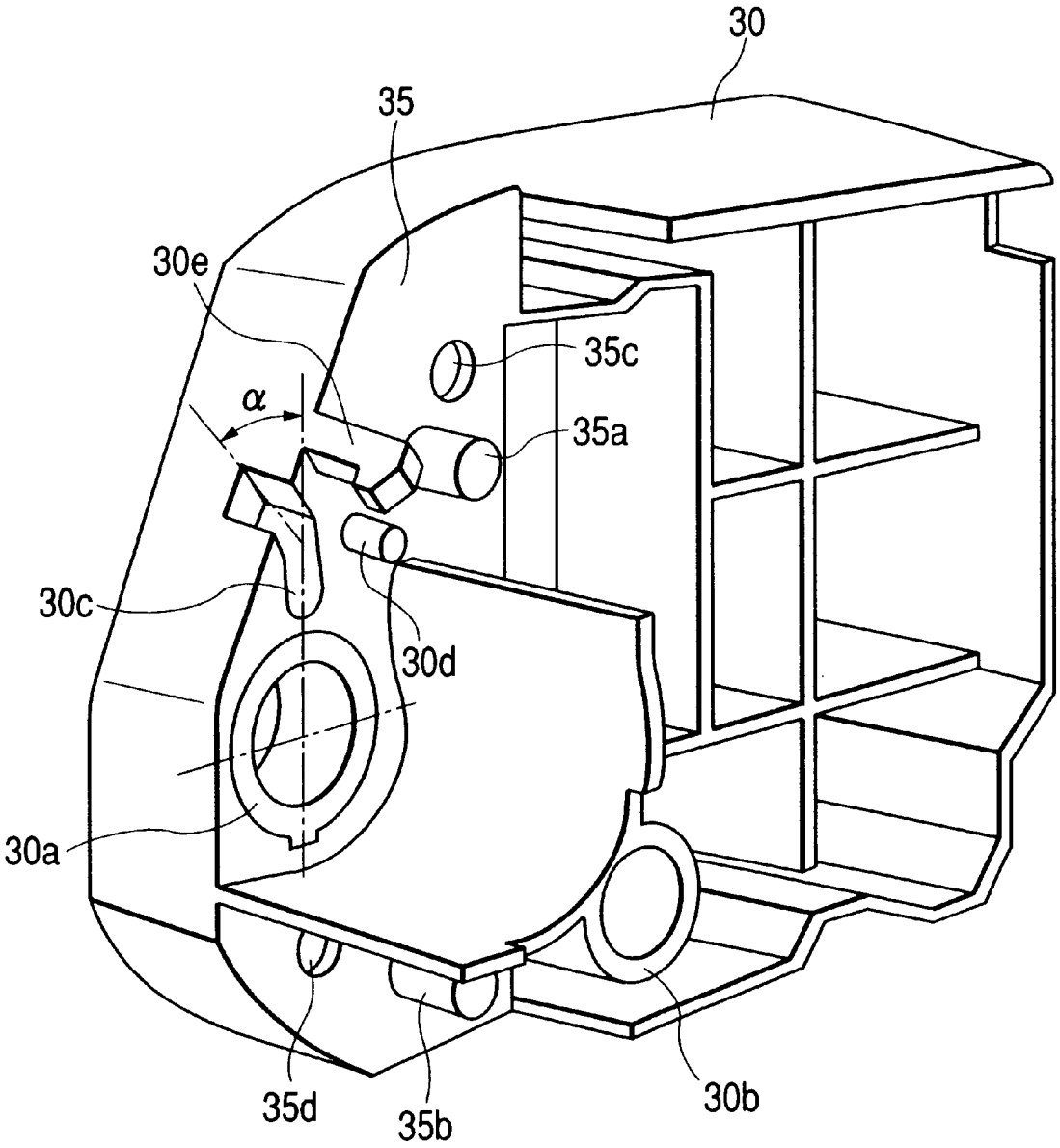
FIG. 6 is an exploded perspective view of a developing device according to an embodiment of the present invention.

FIG. 6 shows the developing bearing 30 provided on the non-drive side end of the developing frame. The developing bearing 30 has a shape for covering the longitudinal end of the developing frame 20 and has an attachment face 35 to the developing frame 20*a*.

The attachment face 35 is provided with positioning bosses 35*a*, 35*b* fitted into positioning holes 60*a*, 60*b* (FIG. 4) provided in an attachment face 60 of the developing frame 20*a*. The bearing is secured to the developing frame 20*a* by inserting and tightening small screws (not shown) with respect to outer holes 35*c*, 35*d* at positions corresponding to female screws 60*c*, 60*d* of the developing frame 20*a*.

Figure 7:
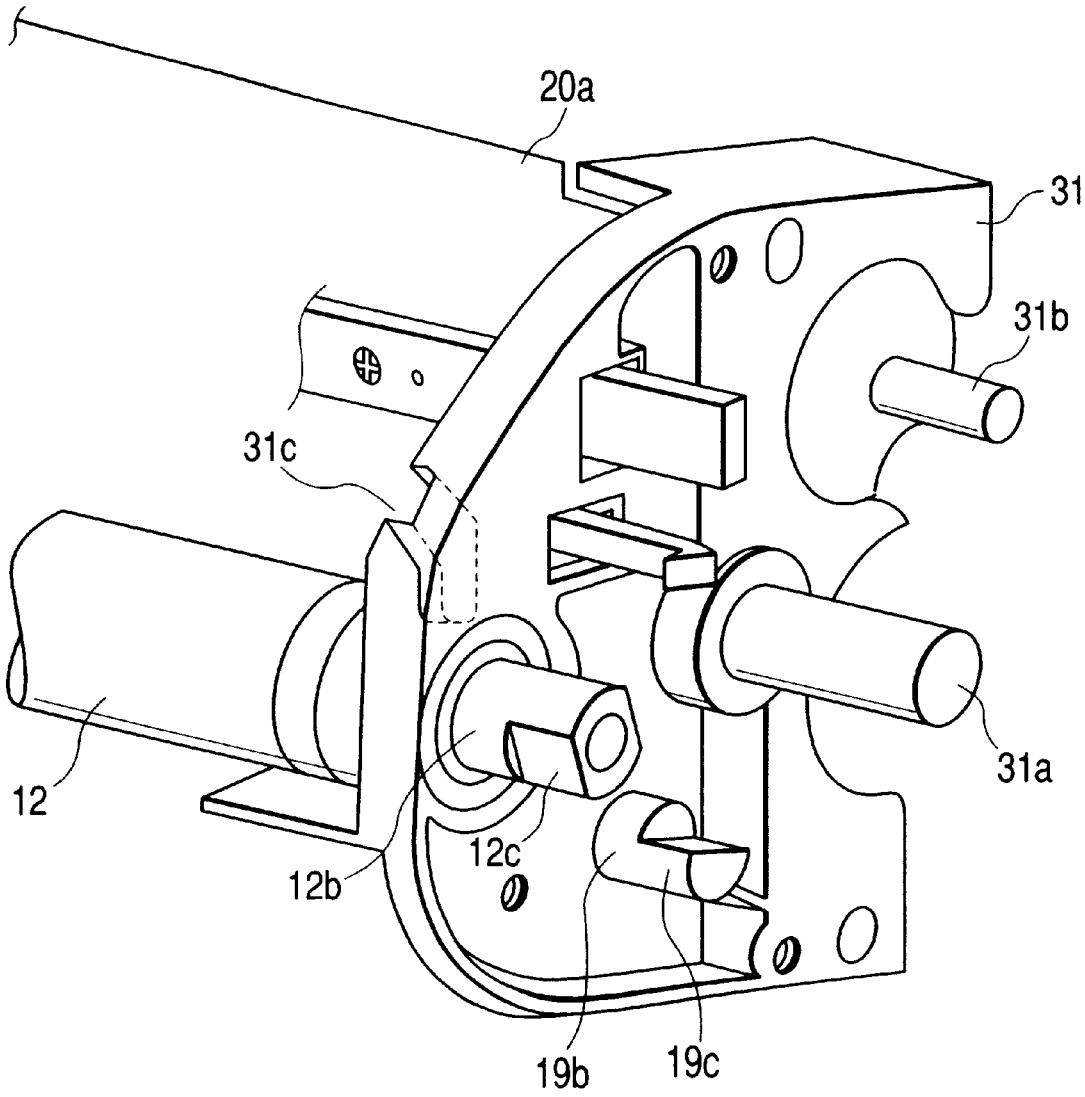
FIG. 7 is an exploded perspective view of a developing device according to an embodiment of the present invention.

FIG. 7 shows the developing bearing 31 provided on the drive side end of the developing frame. The developing bearing 31 is positioned and secured with respect to the developing frame 20*a* in the same manner as the developing bearing 30 provided on the non-drive side end of the developing frame.

Figure 8:
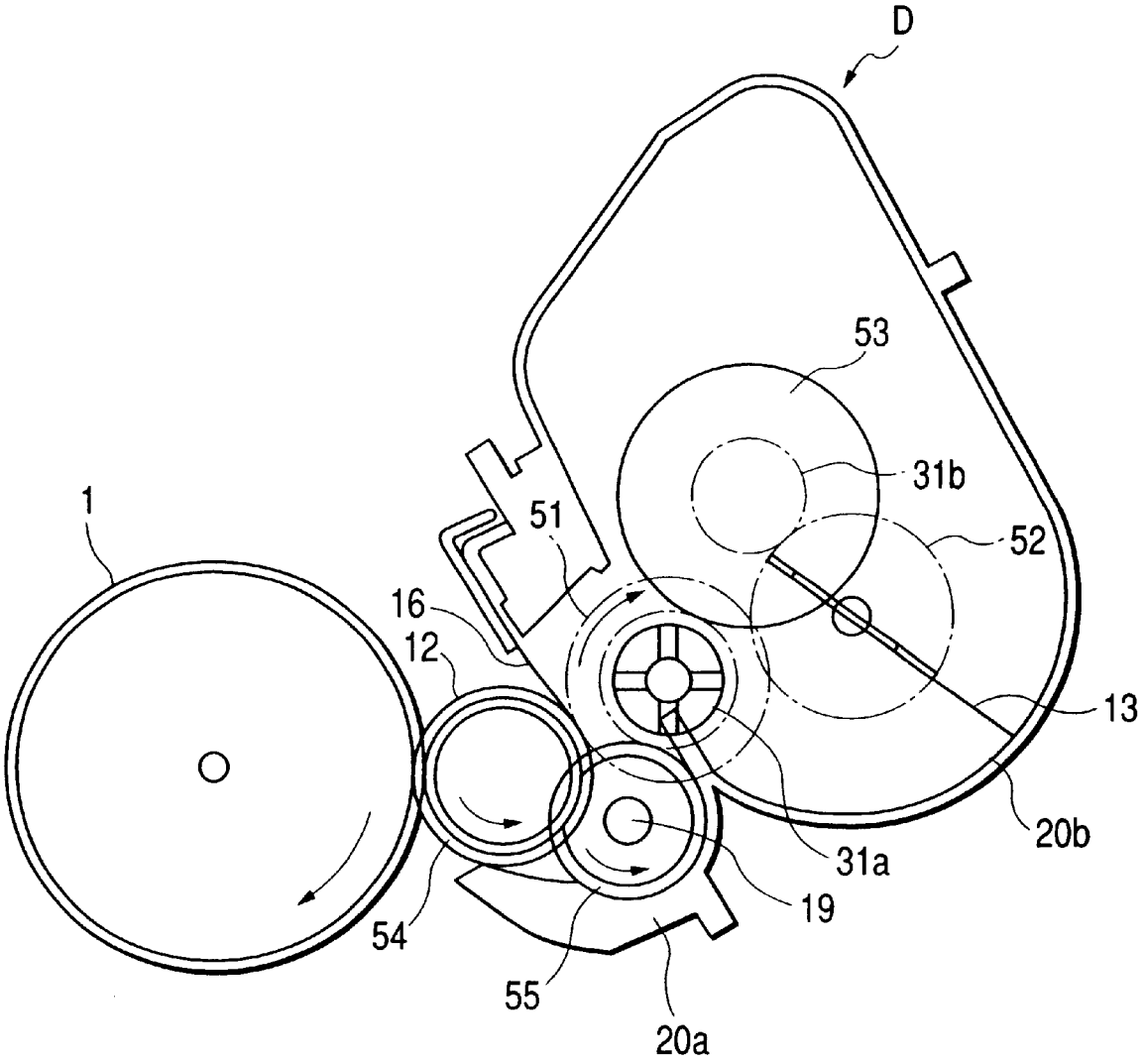
FIG. 8 is a sectional view showing an example of driving of the developing device according to the embodiment of the present invention.

As shown in FIGS. 7 and 8, the developing bearing 31 is provided with a shaft 31*a* for supporting a drive input member 51 through which the driving force is inputted from the main body of the image forming apparatus to the developing cartridge, and a shaft 31*b* for supporting an idler gear 53 meshed with a toner carrying gear 52 provided coaxially with the toner carrying member 13.

Further, shafts 12*b*, 19*b* of the developing roller 12 and toner supplying roller 19 are passed through the drive side developing bearing 31, and driving gears 54, 55 are attached to ends 12*c*, 19*c* of these rollers. By attaching such drive input member and gears, the driving force is inputted to the developing cartridge D. The driving force inputted from the drive input member 51 is transmitted to the toner carrying gear 52 through a gear coaxial with the input member 51 and the idler gear 53. Further, the driving force of the drive input member 51 is also transmitted to the drive gears 54, 55.

Now, main portions of the present invention will be explained.

First of all, attachment of the developing roller 12 and the charging roller 14 will be described. As shown in FIG. 6, the developing bearing 30 is provided with a developing roller bearing portion 30*a*, a toner supplying roller bearing portion 30*b* and a charging roller bearing portion 30*c*.

Further, there is provided a boss 30*d* for attaching a torsion coil spring 56 as biasing means for the charging roller 14. The charging roller bearing portion 30*c* constitute a substantially U-shaped guide groove extending in a direction connecting between a center of the charging roller 14 and a center of the developing roller 12.

The attachment of the developing roller 12 and the charging roller 14 to the developing frame 20*a* is effected as follows. Here, although explanation is made by using the Figure showing the nondrive side, the drive side has the similar construction.

As shown in FIGS. 4 and 6, a side surface of the developing frame 20*a* is the attachment seat surface 60 for attaching the developing bearing 30 and has the positioning holes 60*a*, 60*b* for effecting the positioning with respect to the developing bearing 30. The positioning hole 60*a* is a circular hole and the positioning hole 60*b* is an elongated hole extending in a direction connecting between centers of these holes.

Further, the seat face 60 is provided with the female screws 60*c*, 60*d* for securing the developing bearing. In addition, when the developing bearings 30, 31 are attached to the side surfaces of the developing frame 20*a*, since the central axis of the developing roller 12 is determined, the both side surfaces of the developing frame 20*a* are parallel with each other, and both side surfaces extend in a direction perpendicular to a contact line obtained when the developing blade 16 abuts against the developing roller 12.

After the toner supplying roller 19, developing blade 16 and seals are attached, the developing roller 12 is installed within the developing frame 20*a* at a predetermined position, and the developing bearing 30 (and the developing bearing 31) are attached in coincidence with the positioning holes 60*a* and 60*b* from both sides, and, at the same time, the developing roller 12 is fitted in the bearing portion 30*a*.

When the developing bearing 30 reaches the developing frame 20*a*, the screws are tightened so that the developing roller 12 is rotatably attached to the developing frame 20*a*.

Figure 9:
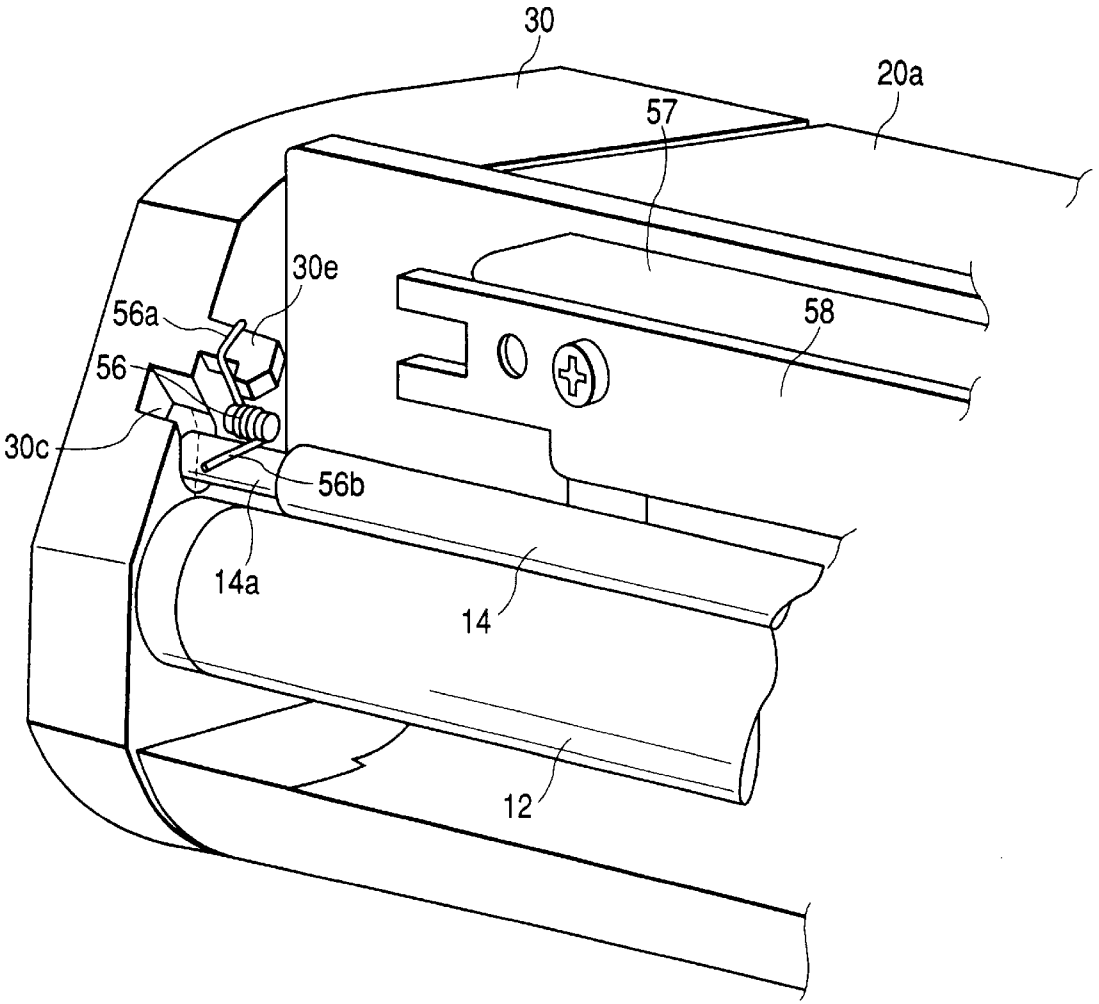
FIG. 9 is an exploded perspective view of a developing device according to an embodiment of the present invention.
Figure 10:
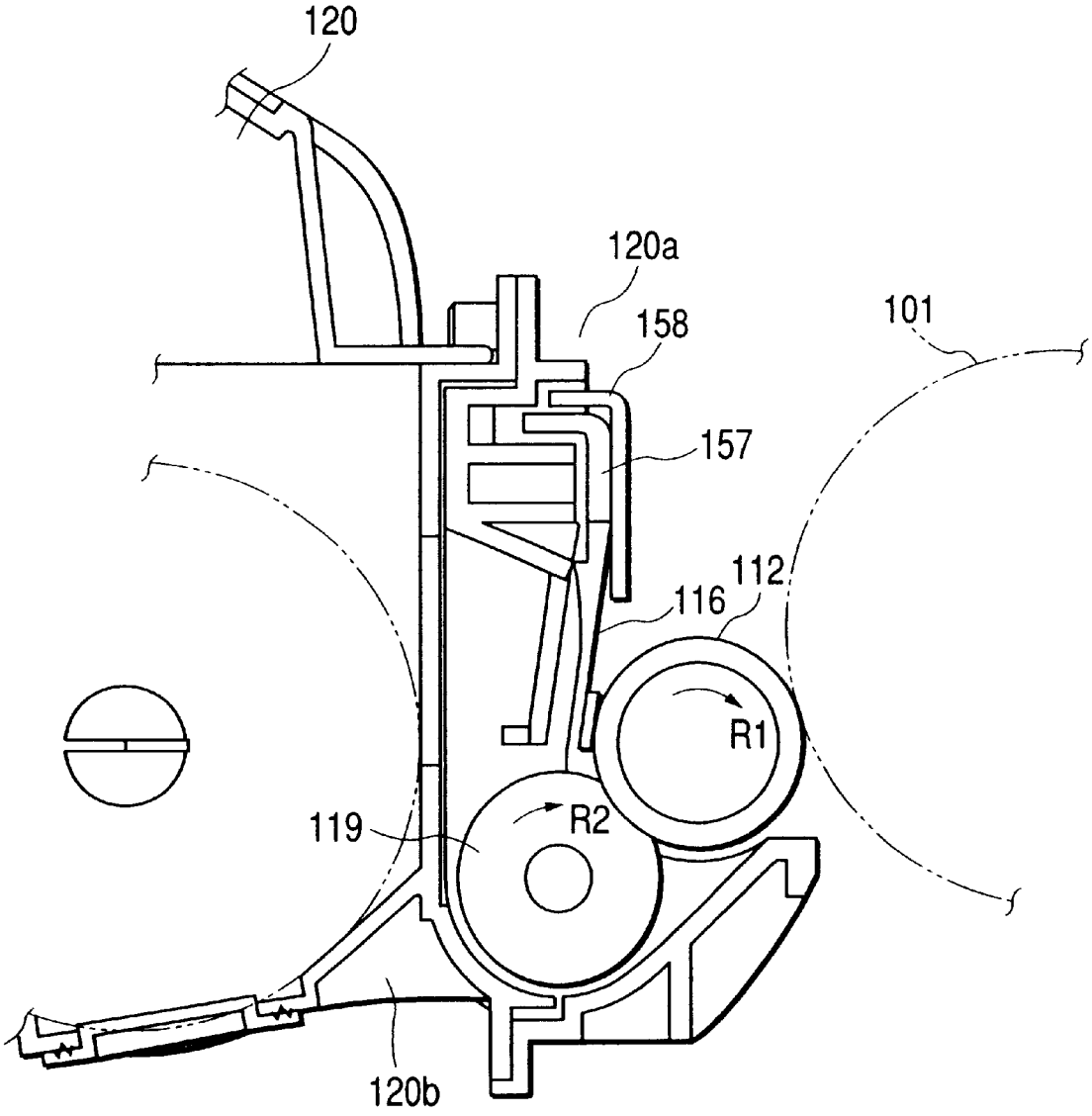
FIG. 10 is a sectional view showing a conventional developing apparatus.

A shown in FIG. 9, when the developing bearing 30 (and the developing bearing 31) are attached, bearing portions for the charging roller 14 are formed on both sides of the developing frame 20*a* by the charging roller bearing portion (guide groove) 30*c* and the charging roller bearing portion (guide groove) 31 of the drive side developing bearing 30. Along the bearing portion formed in this way, the charging roller 14 is inserted from an opening end of the bearing portion until the charging roller abuts against the developing roller 12.

Then, the torsion coil spring 56 is attached to the boss 30*d* of the developing bearing 30, and one end 56*a* of the spring is locked to a stopper 30*e* and the other end 56*b* is locked to a shaft 14*a* of the charging roller 14, with the result that the charging roller 14 is urged against the developing roller 12. In this way, the assembling of the charging roller 14 is completed. The charging roller 14 is driven with respect to the developing roller 12 by a friction force between these rollers.

In this case, since the developing roller bearing portion 30*a*, charging roller bearing portion 30*c* and charging roller pressurizing spring boss 30*d* are provided on the same part (developing bearing 30), the central axis of the developing roller 12 is hard to be deviated from the central axis of the charging roller 14, and since the position of the torsion coil spring 56 as means for pressurizing the charging roller 14 is determined only by accuracy of the part, a stable pressurizing force (biasing force) can be obtained.

A direction of the opening end of the charging roller bearing portion 30*c* of the developing bearing 30 is changed on the way by an angle $\alpha$ in FIG. 6 (i.e., the charging roller bearing portion 30*c* is provided to guide the shaft 14*a* of the charging roller 14 from the opening portion through a curved path toward the direction along which the developing roller 12 is biased by the charging roller 14), for reasons that operability of attaching the charging roller 14 is enhanced and that the charging roller 14 is prevented from being off by vibration and the like during transportation.

Further, electricity is supplied to the charging roller 14 through an electrode plate (not shown) formed from an elastic plate contacted with the end surface of the charging roller or though the pressurizing spring 56 for the charging roller 14. AC voltage is applied to the charging roller 14.

As mentioned above, since the developer charging member is held by the holding member together with the developer carrying member, the positional relationship between the developer charging member and the developer carrying member can stably be established, and the charging amount on the developer carrying member can stably be obtained regardless of the environmental condition, thereby stably permitting formation of an image always having high quality.

Further, since the developer charging member applies the charges to the developer as the thin developer layer coated on the developer carrying member by the developer regulating member, the uniform charging amount can be supplied to the developer on the developer carrying member.

Further, since the developer charging member is a rotary member contacted with the developer carrying surface of the developer carrying member can be uniformly charged without distortion of the layer, and the assembling ability can be enhanced.

Further, since the holding member has the biasing means for biasing the developer charging member against the developer carrying member, the stable biasing force can be obtained.

Further, since the holding member has the guide groove, the assembling ability can be enhanced.

Further, since the guide groove guides the shaft of the developer charging member from the opening end of the holding member through the curved path, the assembling ability can be enhanced and the developer charging member can be prevented from being dislodged by vibration and the like during transportation.

What is claimed is:

1. A developing apparatus comprising:

a developing frame having an opening portion;

a developer carrying member provided in said opening portion and being adapted to carry developer;

a developer charging member contacted with said developer carrying member and being adapted to charge the developer carried by said developer carrying member, wherein a voltage is applied to said developer charging member; and a holding member provided at a longitudinal end portion of said developing frame and adapted to hold said developer carrying member and said developer charging member, wherein said developer charging member includes a shaft portion, and said holding member includes a guide groove portion through which said shaft portion can be guided from an opening end portion after said holding member is attached to said developing frame.

2. A developing apparatus according to claim 1, further comprising a developer regulating member for regulating a thickness of a layer of the developer carried on said developer carrying member, wherein said developer charging member is disposed at a downstream side of said developer regulating member and at an upstream side of a development portion where the developer is supplied from said developer carrying member to an image bearing member, in a developer carrying direction of said developer carrying member.

3. A developing apparatus according to claim 1, wherein said developer charging member is a rotary member.

4. A developing apparatus according to claim 1, wherein said holding member shiftably holds said developer charging member, and said apparatus further comprising a biasing member for biasing said developer charging member against said developer carrying member.

5. A developing apparatus according to claim 1, wherein said guide groove portion is provided to be extended from said opening end portion toward a direction approaching to said developer carrying member.

6. A developing apparatus according to claim 5, wherein said guide groove portion has a curved portion.

7. A developing apparatus according to any one of claims 1 to 4, 5, or 6, wherein said developing apparatus is provided, together with an image bearing member, in a process cartridge detachably attachable to an image forming apparatus.

* * * * *

UNITED STATES PATENT AND TRADEMARK OFFICE

CERTIFICATE OF CORRECTION

PATENT NO. : 6,411,791 B2
DATED : June 25, 2002
INVENTOR(S) : Susumi Nittani et al.

It is certified that error appears in the above-identified patent and that said Letters Patent is hereby corrected as shown below:

Column 2,
Line 60, “follwing” should read -- following --.

Column 4,
Line 3, “expose” should read -- exposes --; and
Line 13, “the” should read -- after the --.

Column 5,
Line 32, “in synchronous” should read -- synchronously --.

Column 7,
Line 58, “constitute” should read -- constitutes --.

Column 9,
Line 20, “member” should read -- member, it --.

Column 10,
Line 37, “or 6,” should read -- and 6, --.

Signed and Sealed this

Tenth Day of December, 2002

JAMES E. ROGAN
*Director of the United States Patent and Trademark Office*